US011251520B2

(12) United States Patent
Schwartz

(10) Patent No.: US 11,251,520 B2
(45) Date of Patent: Feb. 15, 2022

(54) 5G MEMBRANE RADIO SHROUD

(71) Applicant: Chad Schwartz, Annandale, NJ (US)

(72) Inventor: Chad Schwartz, Annandale, NJ (US)

(73) Assignee: CCS Technologies LLC, Annandale, NJ (US)

( * ) Notice: Subject to any disclaimer, the term of this patent is extended or adjusted under 35 U.S.C. 154(b) by 0 days.

(21) Appl. No.: 17/128,517

(22) Filed: Dec. 21, 2020

(65) Prior Publication Data

US 2021/0265724 A1 Aug. 26, 2021

Related U.S. Application Data

(63) Continuation-in-part of application No. 16/798,857, filed on Feb. 27, 2020, now Pat. No. 10,971,811.

(51) Int. Cl.
*H01Q 1/42* (2006.01)
*H01Q 1/12* (2006.01)
*H01Q 1/24* (2006.01)

(52) U.S. Cl.
CPC ..... *H01Q 1/42* (2013.01); *H01Q 1/1207* (2013.01); *H01Q 1/1242* (2013.01); *H01Q 1/246* (2013.01); *H01Q 1/427* (2013.01)

(58) Field of Classification Search
CPC ..... H01Q 1/42; H01Q 1/427; H01Q 1/1207; H01Q 1/1242; H01Q 1/246
See application file for complete search history.

(56) References Cited

U.S. PATENT DOCUMENTS 5,742,653 A 4/1998 Erbes et al.
9,357,886 B2 6/2016 Duncan et al.
9,698,477 B1 7/2017 Jabara et al.

FOREIGN PATENT DOCUMENTS

CN 104364967 A * 2/2015 ..... H01Q 1/427

* cited by examiner

*Primary Examiner* — Hoang V Nguyen
(74) *Attorney, Agent, or Firm* — Thomas J. Germinario

(57) ABSTRACT

The present invention is a pole-mountable shroud assembly enclosing one or more wireless telecommunications transceivers and antennas, which extend from the pole and are rigidly attached to the pole by one or more transceiver brackets. A generally circular stationary panel is rigidly attached to the pole, and a generally annular, segmented jacked panel is attached to the pole at a vertical separation distance from the stationary panel. A panel jack, such as a screw or spring jack, connects the jacked panel to the pole so that the panel separation distance and the jacked panel circumference are adjustable. A very thin (not more than one-tenth the minimum transmission wavelength) fabric membrane shroud wraps around the circumference of the two panels, so as to form a generally cylindrical shroud enclosure which surrounds the transceivers/antennas. The panel jack is operative to tension, both vertically and radially, the fabric membrane shroud around the shroud enclosure.

12 Claims, 8 Drawing Sheets

5G MEMBRANE RADIO SHROUD

REFERENCE TO RELATED APPLICATION

The present application is a Continuation-in-Part of U.S. non-provisional utility application Ser. No. 16/798,857, filed Feb. 27, 2020, which is incorporated herein by reference.

FIELD OF INVENTION

The present invention relates to the general field of wireless telecommunications transceivers, and more particularly to shrouds for concealing such transceivers and their antennas.

BACKGROUND OF THE INVENTION 5G transceivers frequently have antennas which are integrated into the transceiver itself. It is usually desirable to conceal the transceivers/antennas from view for aesthetic reasons. But because 5G often uses millimeter wave technology, it is particularly susceptible to attenuation and dispersion by standard radio shrouds, which typically comprise ridged composite panels. Such panels can be one half to six or more wavelengths thick, causing 5G signal attenuation and dispersion. Therefore, there is a need for a very thin 5G shroud.

SUMMARY OF THE INVENTION

The present invention is a pole-mountable shroud assembly enclosing one or more wireless telecommunications transceivers and antennas. The one or more wireless telecommunications transceivers and antennas extend from the pole and are rigidly attached to the pole by one or more transceiver brackets. Extending radially from the pole are a generally circular stationary panel and a generally annular, segmented jacked panel. The stationary panel and the jacked panel are vertically separated by an adjustable panel separation distance, which encompasses the one or more telecommunications transceivers and antennas. The stationary panel can be located either above or below the jacked panel.

The jacked panel comprises multiple circumferential segments, each of which is connected to a pivoting shackle arm. The connections between the circumferential segments and the shackle arms can be direct or through radial arms extending toward the pole from the circumferential segments. The pivoting end of each shackle arm is connected to a spring jack or a screw jack that is connected to, or contained within the pole. The panel jack is operable to move the jacked panel toward or away from the stationary panel, thereby respectively decreasing or increasing the panel separation distance. As the jacked panel is moved away from the stationary panel, the shackle arms pivot so as to move the circumferential segments of the jacked panel radially outward from the pole, thereby expanding the circumference of the jacked panel.

A very thin fabric membrane shroud, having a thickness not more than one-tenth the minimum transmission wavelength, is attached around the circumferences of the stationary panel and the jacked panel, so as to form a generally cylindrical shroud enclosure that surrounds the transceivers/antennas. By increasing the panel separation distance, the panel jack is operable to tension the shroud vertically. By expanding the segmented circumference of the jacked panel, the panel jack is operable to tension the shroud radially.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1A:
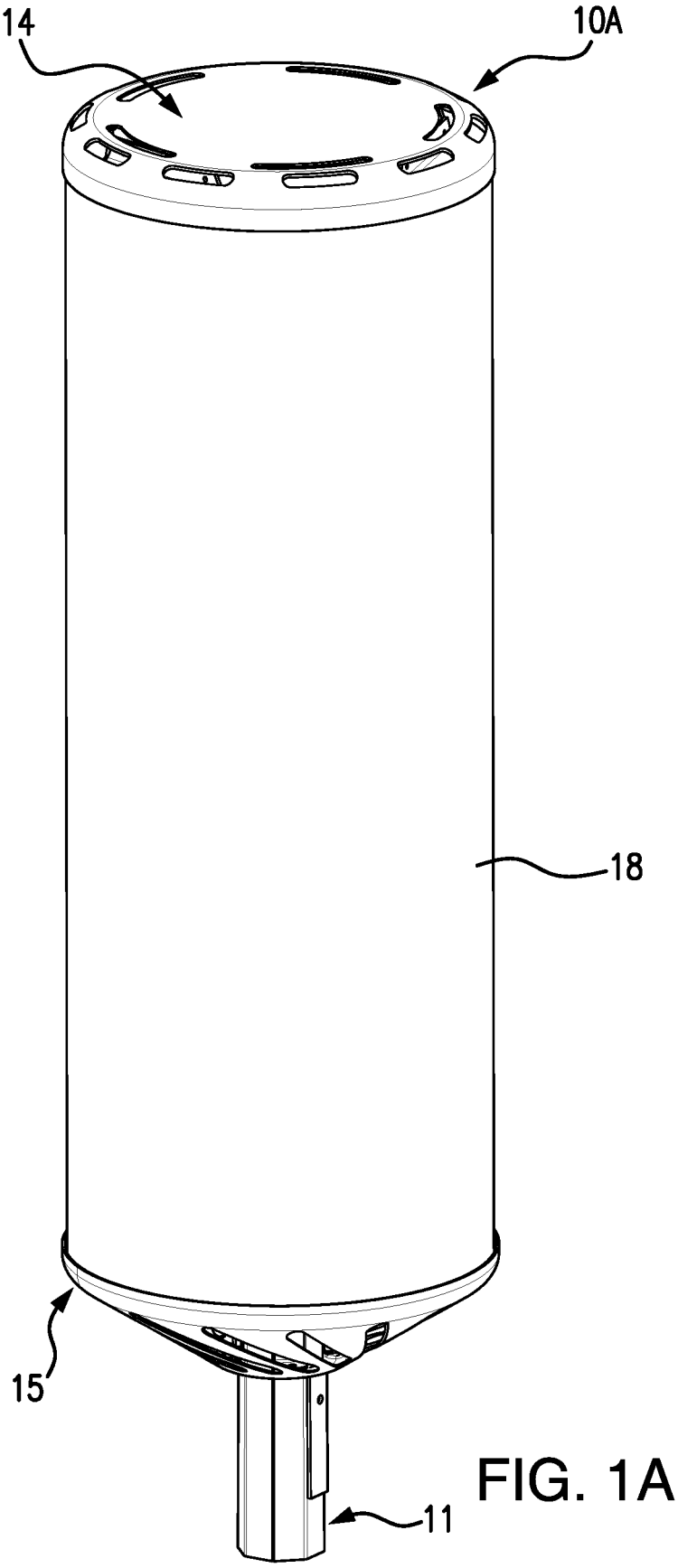
FIG. 1A is perspective view of an exemplary shroud assembly, according to the first embodiment of the present invention.
Figure 1B:
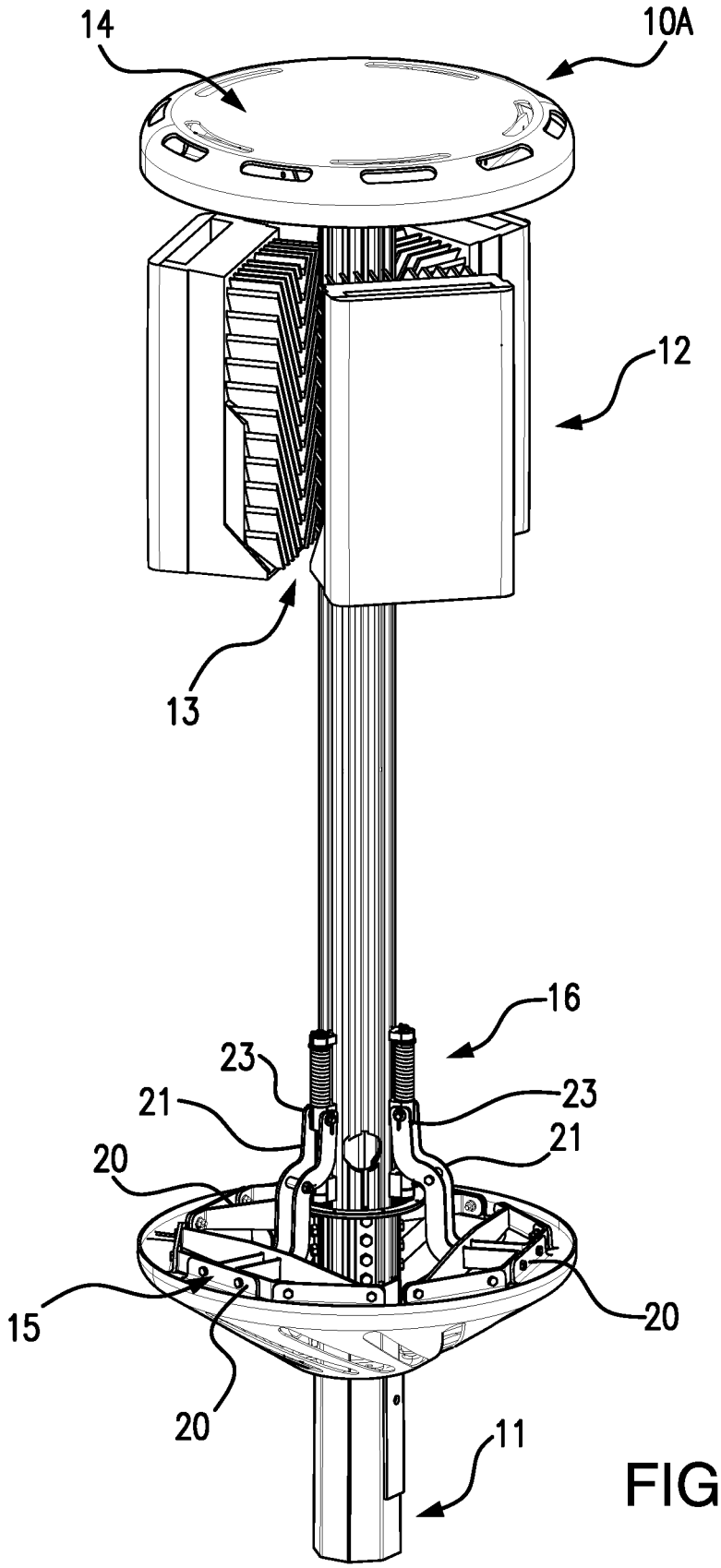
FIG. 1B is a perspective view of the shroud assembly depicted in FIG. 1A, with the shroud removed.
Figure 1C:
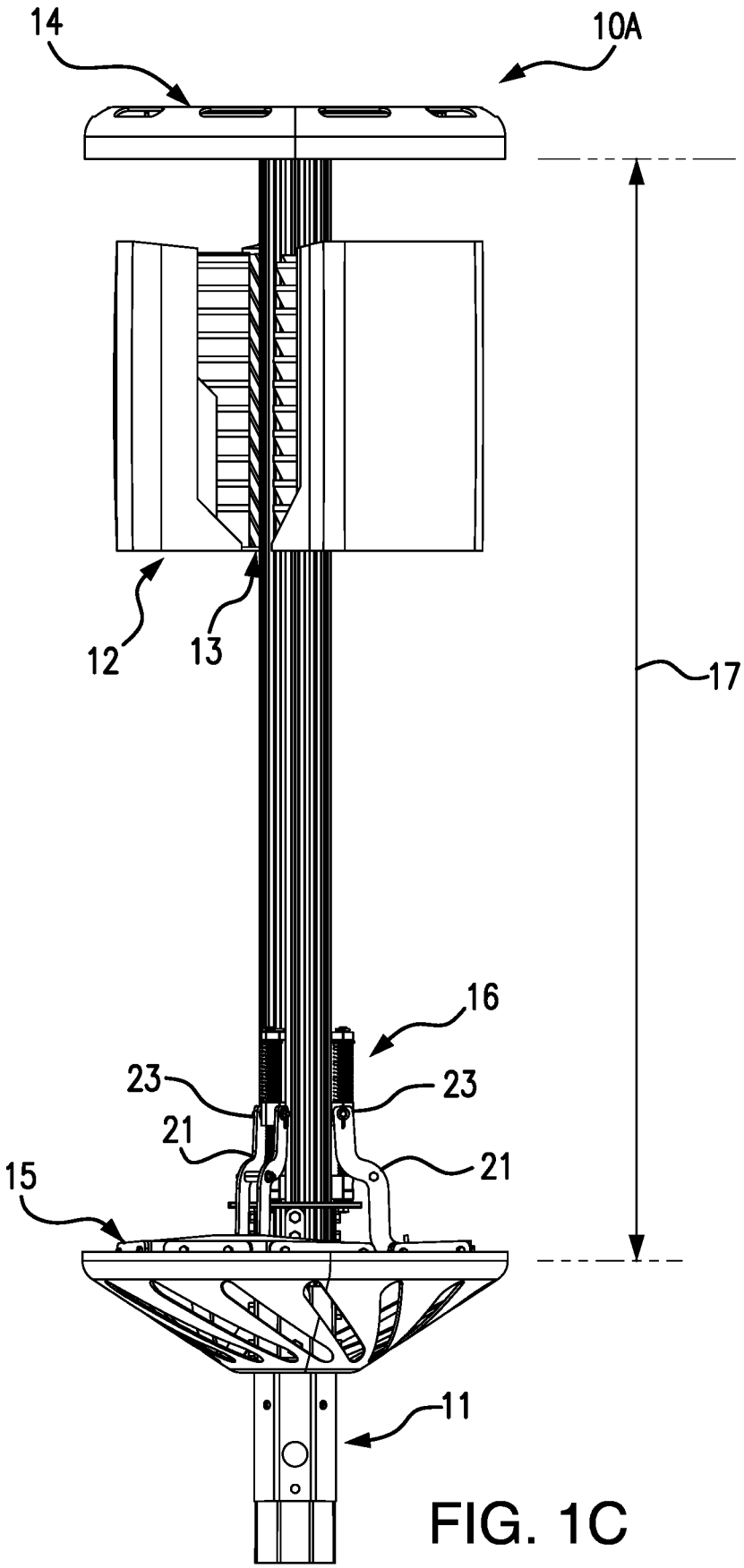
FIG. 1C is a side profile view of the shroud assembly depicted in FIGS. 1A and 1B, with the shroud removed.
Figure 1D:
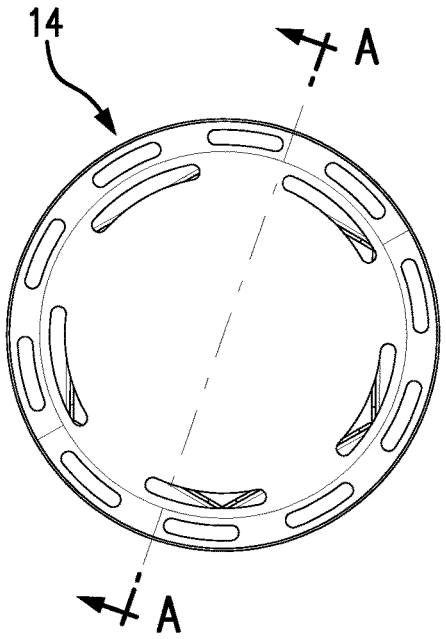
FIG. 1D is top plan view of the shroud assembly depicted in FIGS. 1A-1C.
Figure 1E:
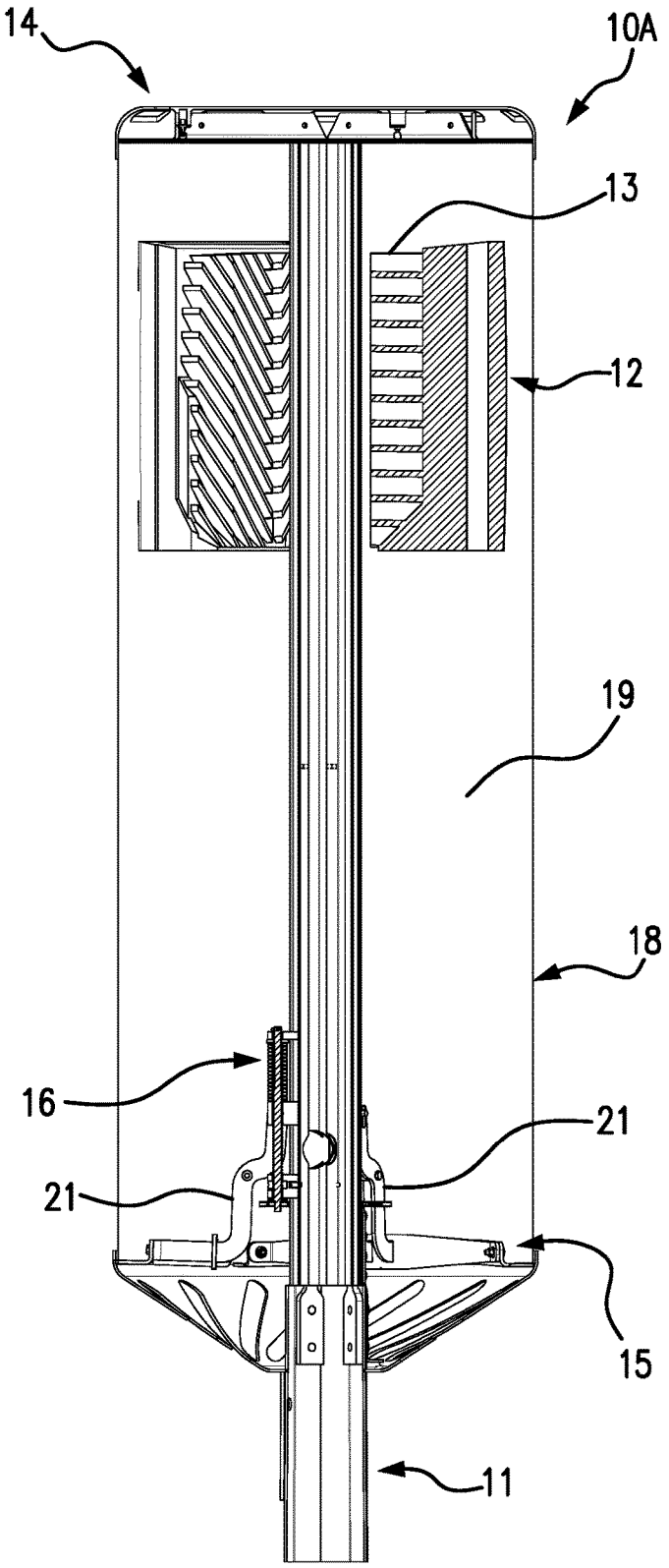
FIG. 1E is a cross-section view of the shroud assembly depicted in FIGS. 1A-1C, taken along the line A-A in FIG. 1D.

Referring to FIGS. 1A-1E, the first exemplary embodiment of the shroud assembly 10A is attachable to a pole 11. As shown in FIGS. 1B, 1C and 1E, the shroud assembly 10 encloses the 5G wireless telecommunications transceiver/antennas 12. The one or more wireless telecommunications transceivers and antennas 12 extend from the pole and are rigidly attached to the pole by one or more transceiver brackets 13. A generally circular stationary panel 14 is rigidly attached at its center to the top of the pole 11, and a generally annular, segmented jacked panel 15 is attached, through a panel jack 15, to the pole 11 at a vertical separation distance 17 from the stationary panel 14. The jacked panel 15 comprises, in this embodiment, three circumferential segments 20, each of which is connected to a pivoting shackle arm 21. The pivoting end 23 of the shackle arm 21 is connected to the panel jack 16, which is attached to the pole 11. The panel jack 16, which in this embodiment is a screw jack, is operable to increase the panel separation distance 17 and, through the pivoting action of the shackle arms 21, to radially expand the circumferential segments 20 of the jacked panel 15, thereby tensioning the shroud 18 both vertically and radially.

Figure 2A:
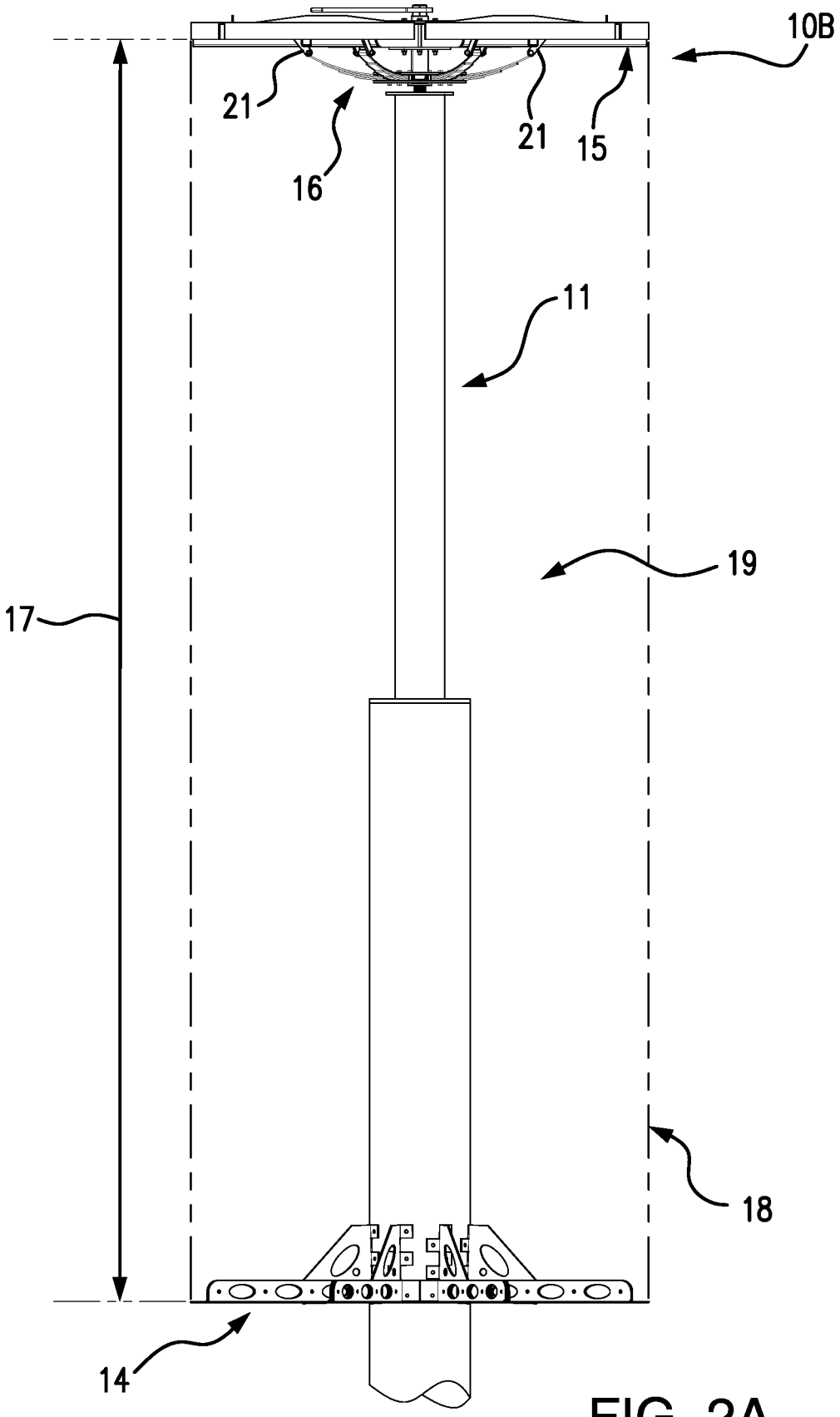
FIG. 2A is a side profile view of an exemplary shroud assembly, according to the second embodiment of the present invention.
Figure 2B:
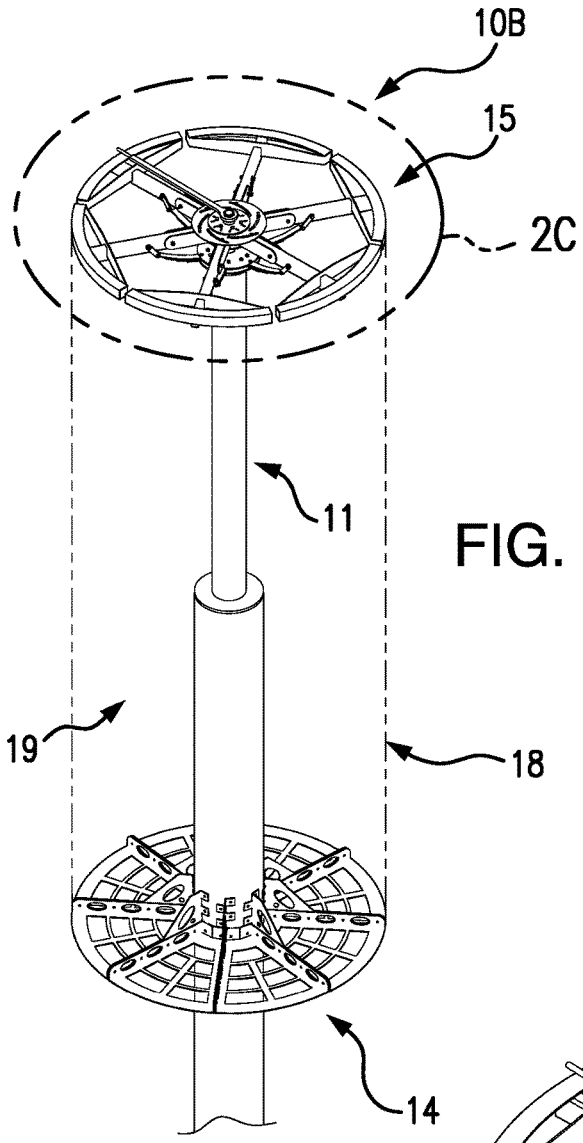
FIG. 2B is a perspective view of the shroud assembly depicted in FIG. 2A.

As best seen in FIG. 2B, the fabric membrane shroud 18 wraps around the perimeters of the stationary panel 14 and jacked panel 15 to form a generally cylindrical shaped shroud enclosure 19 surrounding the transceiver/antennas 12. The screw jack 16 tightens and tensions the shroud 18 around the shroud enclosure 19. Preferably, the shroud 18 has a thickness one-tenth to one-twentieth of the minimum transmission wavelength of the transceiver/antennas 12.

Figure 2C:
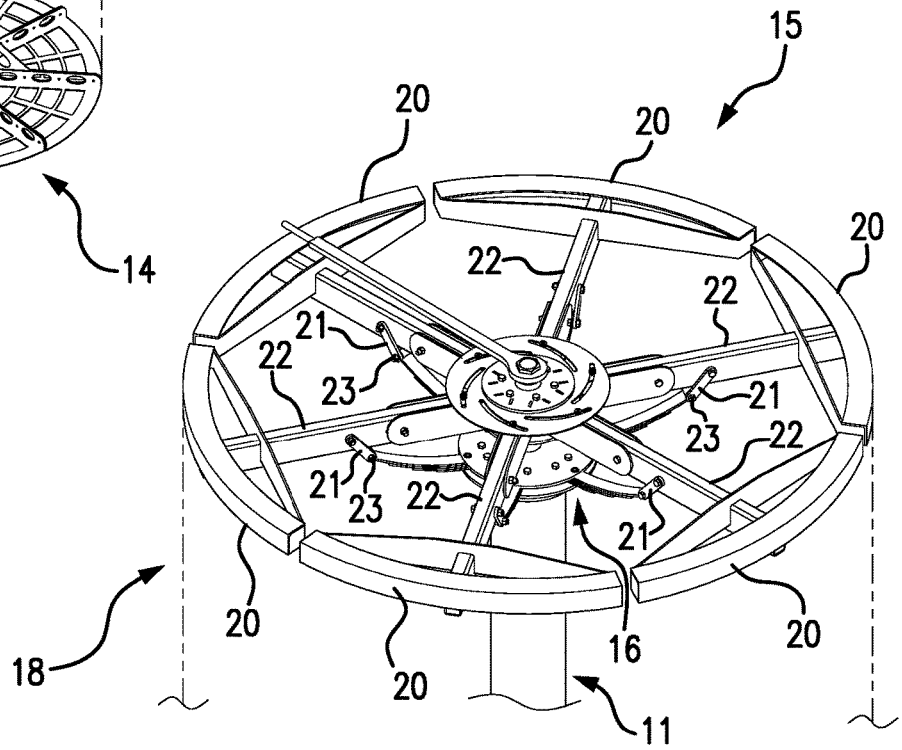
FIG. 2C is a perspective detail view of the jacked panel circled in FIG. 2B.

Referring to FIGS. 2A-2C, the second exemplary embodiment of the shroud assembly 10B is depicted, without the enclosed 5G wireless telecommunications transceivers/antennas 12. The generally circular stationary panel 14 is attached to the pole 11 at the panel separation distance 17 below the generally annular, segmented jacked panel 15. The jacked panel 15 comprises, in this embodiment, six circumferential segments 20, each of which is connected, through a radial arm 22 to a pivoting shackle arm 21. The pivoting end 23 of the shackle arm 21 is connected to the panel jack 16, which is attached to the pole 11. The panel jack 16, which in this embodiment is a leaf spring jack, is operable to increase the panel separation distance 17 and, through the pivoting action of the shackle arms 21, to radially expand the circumferential segments 20, thereby both vertically and radially tensioning the shroud 18. In this second embodiment 10B, the shroud 18 is of the same material and is attached to the shroud assembly in the same manner as in the first embodiment 10A.

Figure 3A:
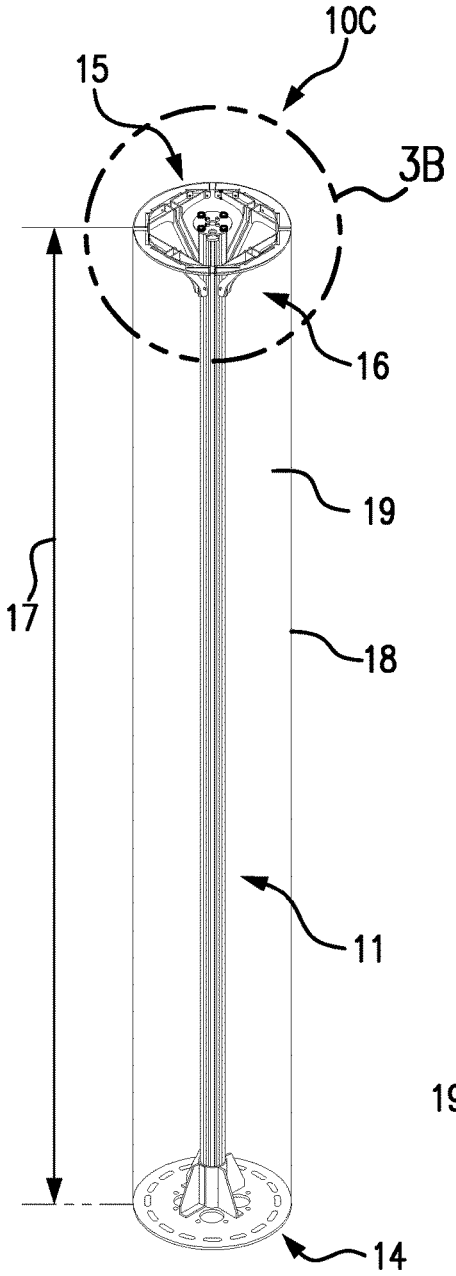
FIG. 3A is perspective view of an exemplary shroud assembly, according to the third embodiment of the present invention.
Figure 3B:
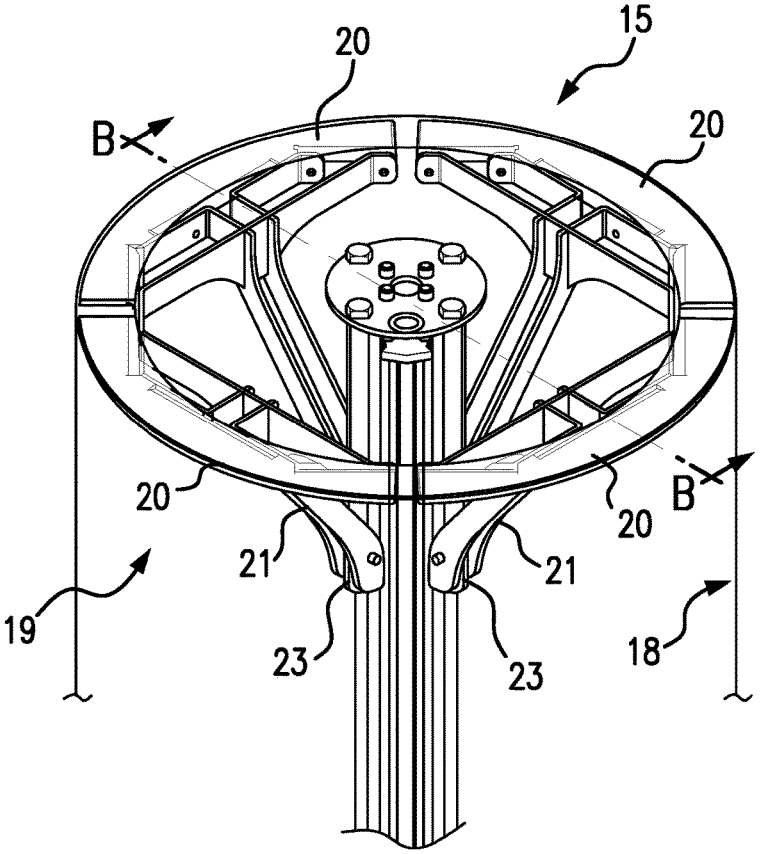
FIG. 3B is a perspective view of the jacked panel circled in FIG. 3A.
Figure 3C:
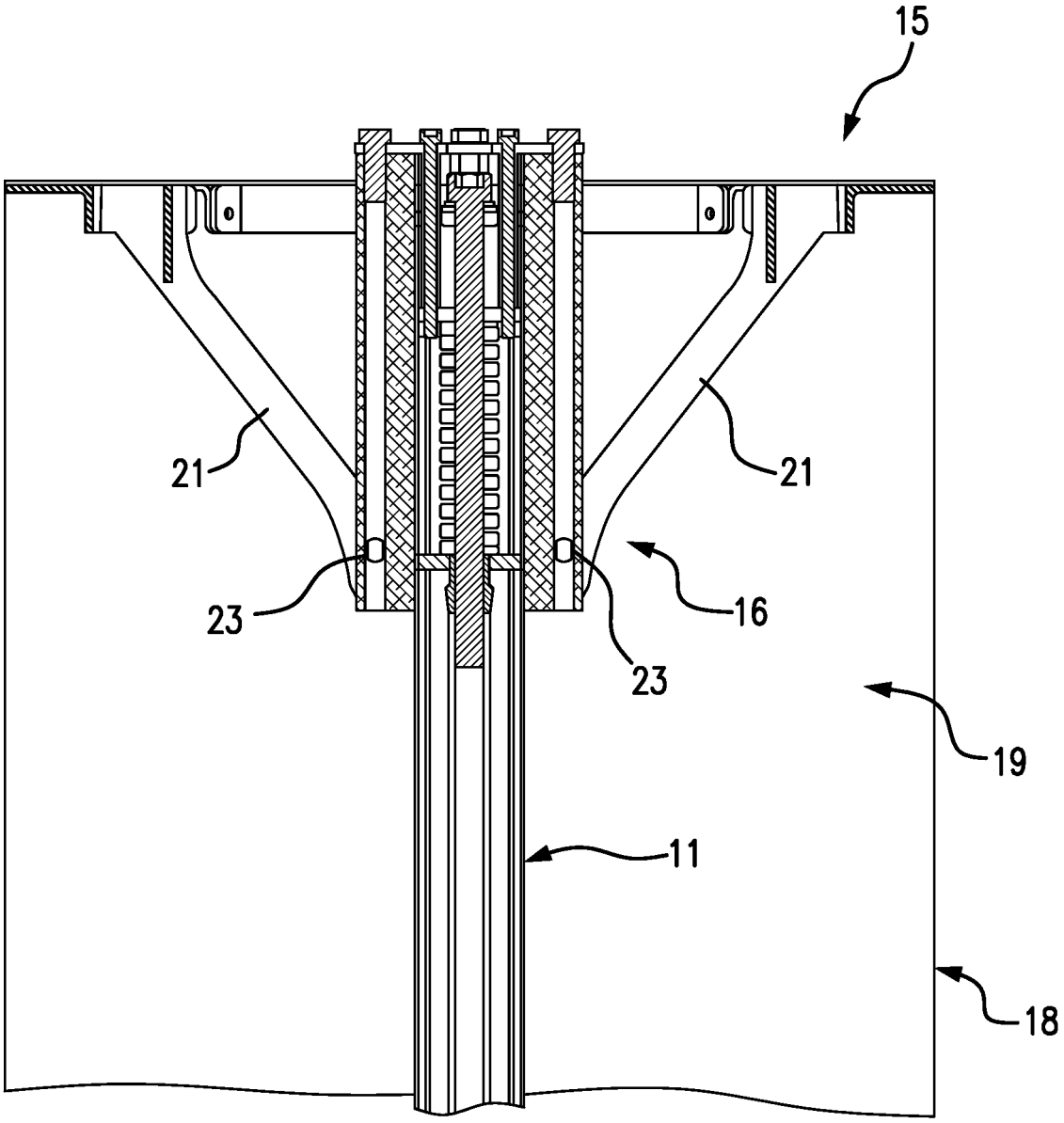
FIG. 3C is cross-section view of the jacked panel depicted in FIGS. 3A and 3B, taken along the line B-B in FIG. 3B.

Referring to FIGS. 3A-3C, the third exemplary embodiment of the shroud assembly 10C is depicted, without the enclosed 5G wireless telecommunications transceivers/antennas 12. The generally circular stationary panel 14 is attached to the pole 11 at the panel separation distance below the generally annular, segmented jacked panel 15. The jacked panel 15 comprises, in this embodiment, four circumferential segments 20, each of which is connected to a pivoting shackle arm 21. The pivoting end 23 of the shackle arm 21 is connected to the panel jack 16, which is attached to the pole 11. The panel jack 16, which in this embodiment is a coil spring jack, is operable to increase the panel separation distance 17 and, through the pivoting action of the shackle arms 21, to radially expand the circumferential segments 20, thereby both vertically and radially tensioning the shroud 18. In this third embodiment 10C, the shroud 18 is of the same material and is attached to the shroud assembly in the same manner as in the first embodiment 10A.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. A shroud assembly, which is adapted to be mounted on a pole, and which encloses one or more wireless telecommunications transceivers and antennas, having a minimum transmission wavelength, the shroud assembly comprising:

a generally circular stationary panel, which is rigidly radially attached to the pole, and which has a stationary panel circumference;

a generally annular, segmented jacked panel, having an adjustable jacked panel circumference, wherein the jacked panel is attached to the pole at an adjustable vertical separation distance from the stationary panel;

a panel jack, which is adjustably attached to or contained within the pole, and through which the jacked panel is connected to the pole, wherein the panel jack is operative to adjust the vertical panel separation distance and to adjust the jacked panel circumference; and a generally tubular, stretchable fabric membrane shroud, having a fabric thickness of less than or equal to one-tenth of the minimum transmission wavelength, wherein the fabric membrane shroud wraps completely around the stationary panel circumference and the jacked panel circumference, so as to form a generally cylindrical shroud enclosure surrounding the wireless telecommunications transceivers and antennas, and wherein, by increasing the panel separation distance and expanding the jacked panel circumference, the panel jack is operative to tension the fabric membrane shroud both vertically and radially around the shroud enclosure.

2. The shroud assembly according to claim 1, wherein the jacked panel comprises multiple circumferential panel segments, and wherein each circumferential panel segment is connected to a pivoting shackle arm, either directly or through a radial arm, and wherein each shackle arm has a pivoting end, which is connected to the panel jack, and wherein, as the panel jack operates to increase the panel separation distance, the panel jack simultaneously moves the circumferential panel segments of the jacked panel radially outward from the pole, so as to expand the jacked panel circumference, thereby simultaneously tensioning the shroud vertically and radially.

3. The shroud assembly according to claim 2, wherein the panel jack comprises one or more screw jacks.

4. The shroud assembly according to claim 3, wherein the fabric thickness is in the range of one-tenth to one-twentieth of the minimum transmission wavelength.

5. The shroud assembly according to claim 2, wherein the panel jack comprises one or more spring jacks.

6. The shroud assembly according to claim 5, wherein the fabric thickness is in the range of one-tenth to one-twentieth of the minimum transmission wavelength.

7. The shroud assembly according to claim 2, wherein the fabric thickness is in the range of one-tenth to one-twentieth of the minimum transmission wavelength.

8. The shroud assembly according to claim 1, wherein the panel jack comprises one or more screw jacks.

9. The shroud assembly according to claim 8, wherein the fabric thickness is in the range of one-tenth to one-twentieth of the minimum transmission wavelength.

10. The shroud assembly according to claim 1, wherein the panel jack comprises one or more spring jacks.

11. The shroud assembly according to claim 10, wherein the fabric thickness is in the range of one-tenth to one-twentieth of the minimum transmission wavelength.

12. The shroud assembly according to claim 1, wherein the fabric thickness is in the range of one-tenth to one-twentieth of the minimum transmission wavelength.

* * * * *